US007085505B2

(12) United States Patent
Itaya

(10) Patent No.: US 7,085,505 B2
(45) Date of Patent: Aug. 1, 2006

(54) IMAGE FORMING APPARATUS WHICH MONITORS LIFETIMES OF EXPENDABLES

(75) Inventor: Satoshi Itaya, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 862 days.

(21) Appl. No.: 10/025,249

(22) Filed: Dec. 19, 2001

(65) Prior Publication Data

US 2003/0112458 A1 Jun. 19, 2003

(51) Int. Cl.
*G03G 15/00* (2006.01)

(52) U.S. Cl. ..... 399/24; 399/25; 347/19

(58) Field of Classification Search ..... 358/1.15, 358/1.16, 406; 399/25, 27, 24, 35; 347/19
See application file for complete search history.

(56) References Cited

U.S. PATENT DOCUMENTS 5,802,420 A * 9/1998 Garr et al. ..... 399/27
6,512,896 B1 * 1/2003 Asanuma et al. ..... 399/27
2002/0172520 A1 * 11/2002 Suyehira ..... 399/24

FOREIGN PATENT DOCUMENTS

JP 2000-298572 A 10/2000

* cited by examiner

*Primary Examiner*—Mark Zimmerman
*Assistant Examiner*—Vincent M. Rudolph
(74) *Attorney, Agent, or Firm*—Frishauf, Holtz, Goodman & Chick, P.C.

(57) ABSTRACT

An image forming apparatus disclosed herein includes a detecting section for detecting that the lifetime of an expendable used to form images is expiring, a counting section for counting a used amount of the expendable when the detecting section detects that the lifetime of the expendable is expiring, and a control section for disregarding the fact that the lifetime of the expendable is expiring, even when the fact is detected again before the used amount of the expendable, which is counted by the counting section, reaches a prescribed value.

8 Claims, 5 Drawing Sheets

IMAGE FORMING APPARATUS WHICH MONITORS LIFETIMES OF EXPENDABLES

BACKGROUND OF THE INVENTION

1. Field of the Invention

The present invention relates to an imaging forming apparatus that can detect that the lifetime of the expendables used in it to form images is expiring.

2. Description of the Related Art

An image forming apparatus connected to the Internet by a server or the like may detect that the lifetime of the expendables, such as a process unit, a toner cartridge and the like, is expiring. When the image forming apparatus detects that the lifetime of any expendable is expiring, it automatically prepares an order sheet of a prescribed format, automatically placing an order for the expendable with a technical service agency via the Internet. Since the image forming apparatus automatically sends the order for the expendable, the user of the apparatus need not contact the serviceman at the agent, thus saving labor. Moreover, upon receiving the order the serviceman knows that the lifetime of the expendable is expiring and can therefore promptly deal with the apparatus.

After the image forming apparatus automatically places an order upon detecting that the lifetime of the expendable is expiring, the user may turn on or off the power switch of the apparatus, or may opens or closes the cover of the apparatus. In this case, the image forming apparatus again detects that the lifetime of the expendable is expiring. This is because the data representing this fact is no longer stored in the apparatus. Consequently, the apparatus immediately sends an order, which overlaps the order previously placed.

BRIEF SUMMARY OF THE INVENTION

An object of the invention is to provide an image forming apparatus that detects which neglects the fact that the lifetime of the expendables is expiring, if the fact is detected again within a predetermined time after the fact has been detected before, and also a method of operating this image forming apparatus.

An image forming apparatus according to an aspect of the invention comprises: a detecting section which detects that a lifetime of an expendable used to form images is expiring; a counting section which counts a used amount of the expendable when the detecting section detects that the lifetime of the expendable is expiring; and a control section which disregards the fact that the lifetime of the expendable is expiring, even when the fact is detected again before the used amount of the expendable, which is counted by the counting section, reaches a prescribed value.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and comprise a part of the specification, illustrate presently embodiments of the invention, and together with the general description given above and the detailed description of the embodiments given below, serve to explain the principles of the invention.

DETAILED DESCRIPTION OF THE INVENTION

Embodiment of the present invention will be described, with reference to the accompanying drawings.

First Embodiment

Figure 1:
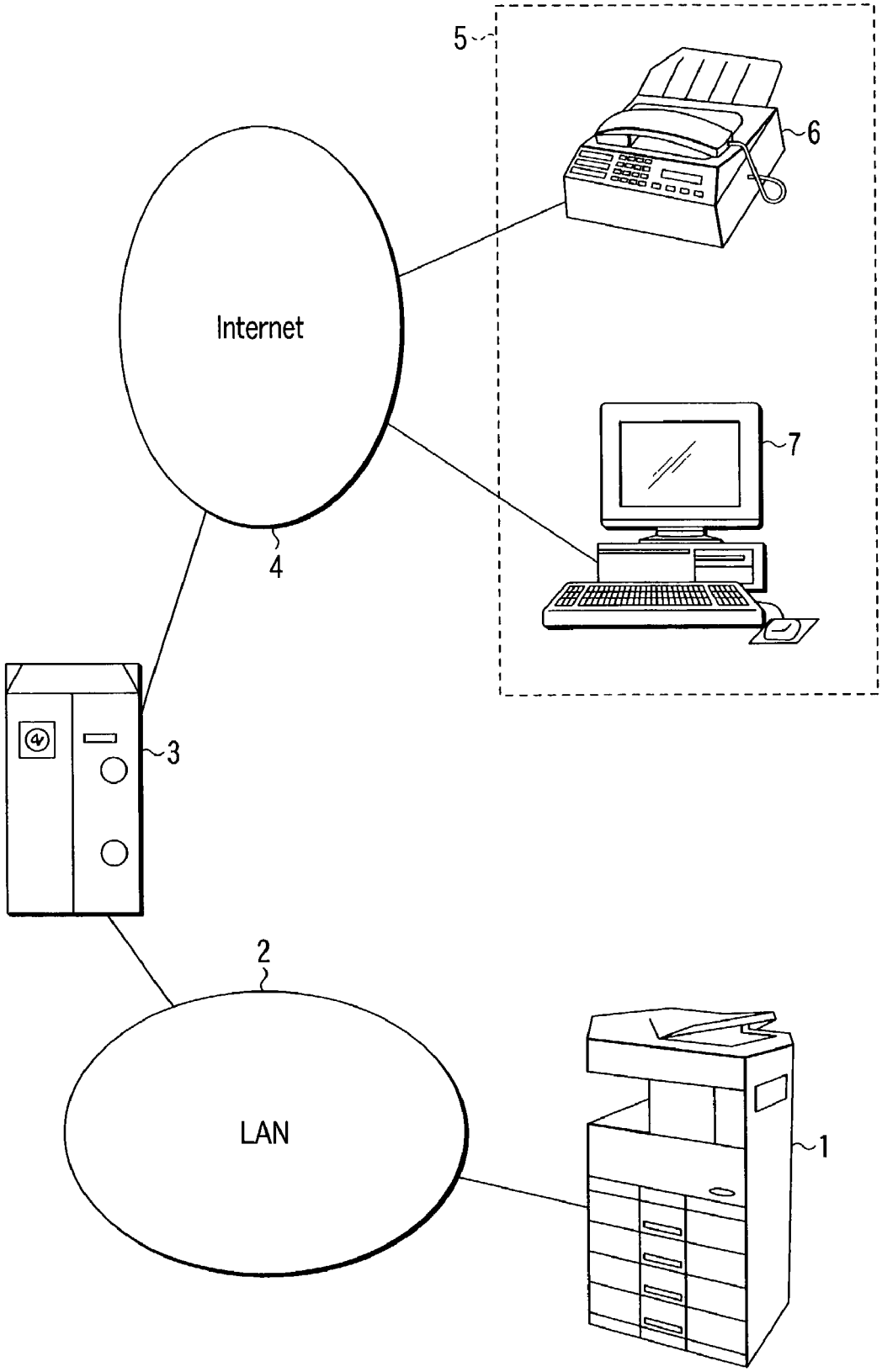
FIG. 1 is a diagram illustrating a network according to the first embodiment of the present invention.

FIG. 1 shows a network configuration. An image forming apparatus 1 is connected to a LAN (Local Area Network) 2 that is provided in an office or the like. A server 3 is connected to the LAN 2. The server 3 can connect the image forming apparatus 1 to the Internet 4. For example, a facsimile apparatus 6 and a computer 7 are connected to the Internet 4. The transmitter/receiver 6 and the computer 7 are installed in a service agency 5 that offers technical service such as replacement of the expendables used in the image forming apparatus 1. Both the facsimile apparatus 6 and the computer 7 operate for the seller of the expendables.

Figure 2:
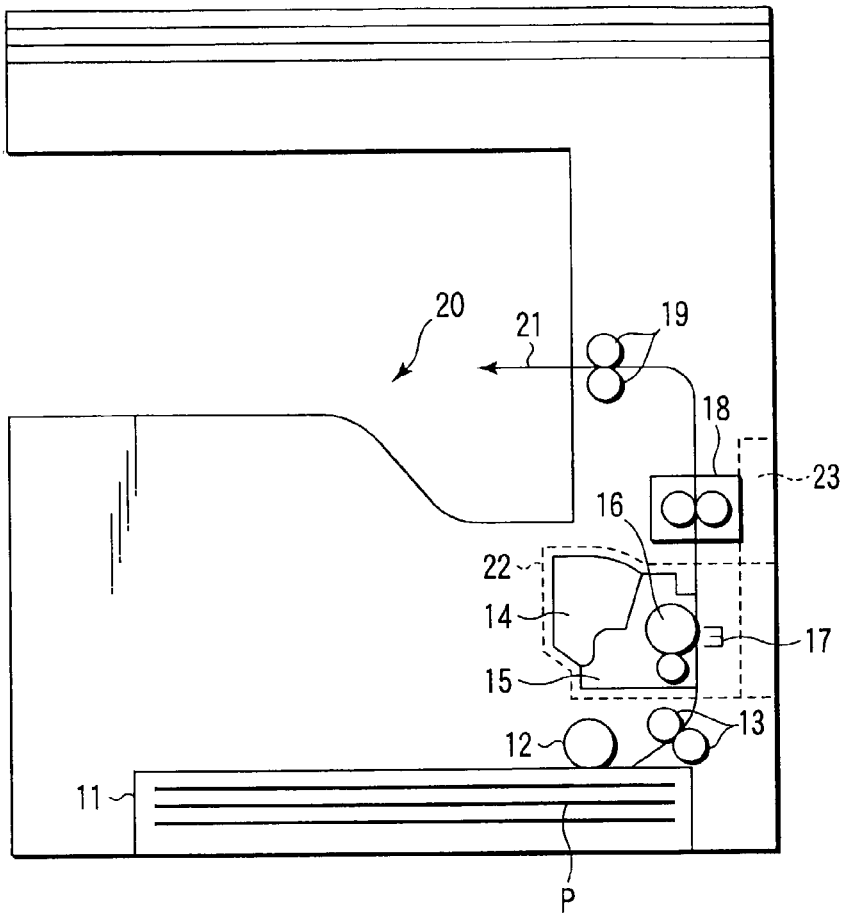
FIG. 2 is a schematic sectional view of an image forming apparatus according to the embodiment.

FIG. 2 is a schematic sectional view of the image forming apparatus 1.

A paper cassette 11 containing paper sheets P is provided at the bottom of the image forming apparatus 1. The paper sheets P may be fed from the cassette 11 by a pickup roller 12 and then transported by a register roller 13. Each paper sheet P thus transported passes through the gap between a drum 16 and a transfer device 17, which are provided in a process unit 15. The process unit 15 is fitted to a toner cartridge 14 that is an expendable. Toner is applied to the circumferential surface of the drum 16, forming a toner image. The toner image is transferred to the paper sheet P as the sheet P passes through the gap between the drum 16 and the transfer device 17. The toner image is fixed as the paper sheet P passes through a fixing device 18. A feed roller 19 ejects the paper sheet P onto a sheet tray section 20. Reference numeral 21 designates the path along which the paper sheet P is transported in the apparatus 1. The toner cartridge 14 and process unit 15 are contained in a receptacle 22. A side cover 23 can be opened, so that the toner cartridge 14 and process unit 15 may be replaced with new ones.

Figure 3:
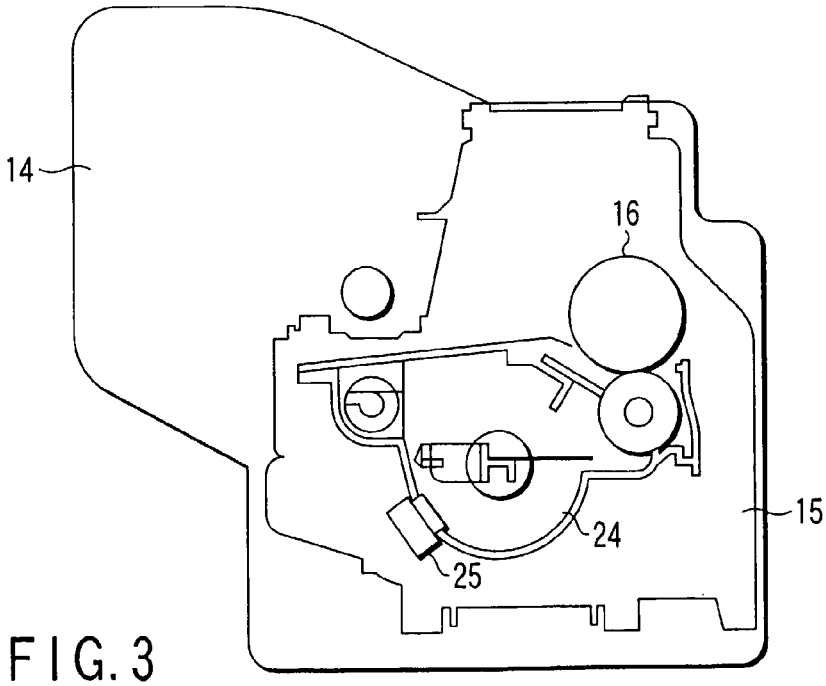
FIG. 3 is a diagram showing the toner cartridge and the process unit, both incorporated in the embodiment.

FIG. 3 illustrates the toner cartridge 14 and the process unit 15. The process unit 15 contains the drum 16 and a developing device 24. A toner sensor 25 is provided at the bottom of the developing device 24. The sensor 25 functions as a detecting section that detects the amount of toner supplied from the toner cartridge 14.

Figure 4:
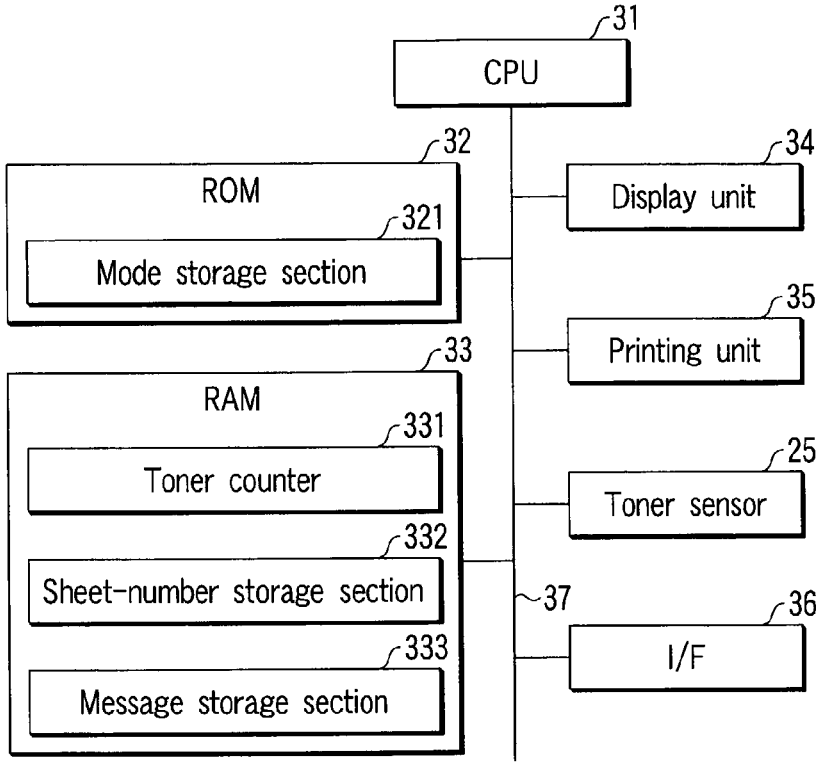
FIG. 4 is a diagram illustrating the control block of the image forming apparatus according to the embodiment.

FIG. 4 is a diagram illustrating the control block of the image forming apparatus 1. FIG. 4 shows a CPU31 as a control section, a ROM 32, a RAM 33, a display unit 34, a printing unit 35, a toner sensor 25, and an I/F (Interface) 36. A bus line 37 connects the ROM 32, RAM 33, display unit 34, printing unit 35, toner sensor 25 and I/F 36 to the CPU 31.

The CPU 31 operates as a control device that controls the image forming apparatus 1.

The ROM 32 stores various programs that the CPU 31 may execute. The ROM 32 includes a mode storage section 321. The section 321 stores data representing an operating mode. In this mode, an order is automatically prepared when it is detected that the lifetime of the toner cartridge 14 is expiring, and the order thus prepared is transmitted to the computer 7 at the agency 5 through the Internet 4.

The RAM 33 has an area for a toner counter 331. The toner counter 331 servers as a counter section that starts counting printed sheets when it is detected that the lifetime of the toner cartridge 14 is expiring, or that the toner cartridge 14 becomes almost empty.

The RAM 33 has an area for a sheet-number storage section 332. The storage section 332 is provided to store a prescribed number of sheets, i.e., a specific printed number of sheets. This printed number of sheets defines a used amount, which neglects the fact that the toner sensor 25 has detected again that the toner is running out. The prescribed number is set at, for example, 500. The prescribed number is initially set at a value greater than a number of sheets, which corresponds to the lifetime of the toner cartridge 14. This prevents placing an order twice for the same toner cartridge.

The RAM 33 has an area for a message storage section 333. This storage section 333 is provided to store various messages the display unit 34 may display when the toner sensor 25 detects, for the second time, that the toner is running out.

The printing unit 35 comprises the toner cartridge 14, the process unit 15, transfer device 17, pickup roller 12, register roller 13 and feed roller 19. It prints data under the control of the CPU 31.

Figure 5:
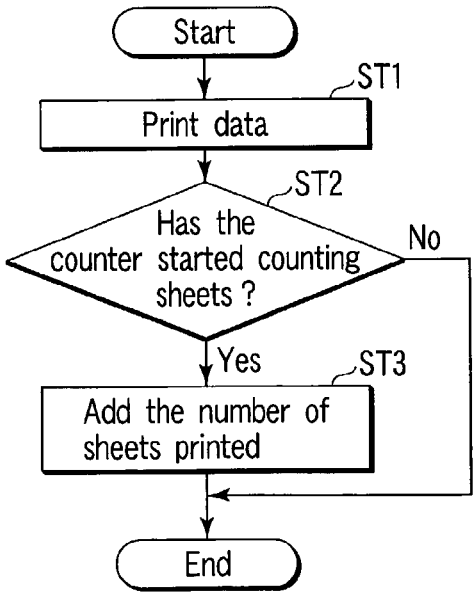
FIG. 5 is a flowchart showing the process of counting sheets printed in the embodiment.

FIG. 5 is a flowchart explaining how the toner counter 331 adds the number of sheets printed, to its count, under the control of the CPU 31. In Step ST1, printing is performed. In Step ST2 it is determined whether the toner counter 331 has started counting sheets. If it is not determined in Step ST2 that the toner counter 331 has started counting sheets, the process is terminated.

If it is determined in Step ST3 that the toner counter 331 has started counting sheets, the toner counter 331 adds the number of the sheets printed, to its count In Step ST4. The process is then terminated.

Figure 6:
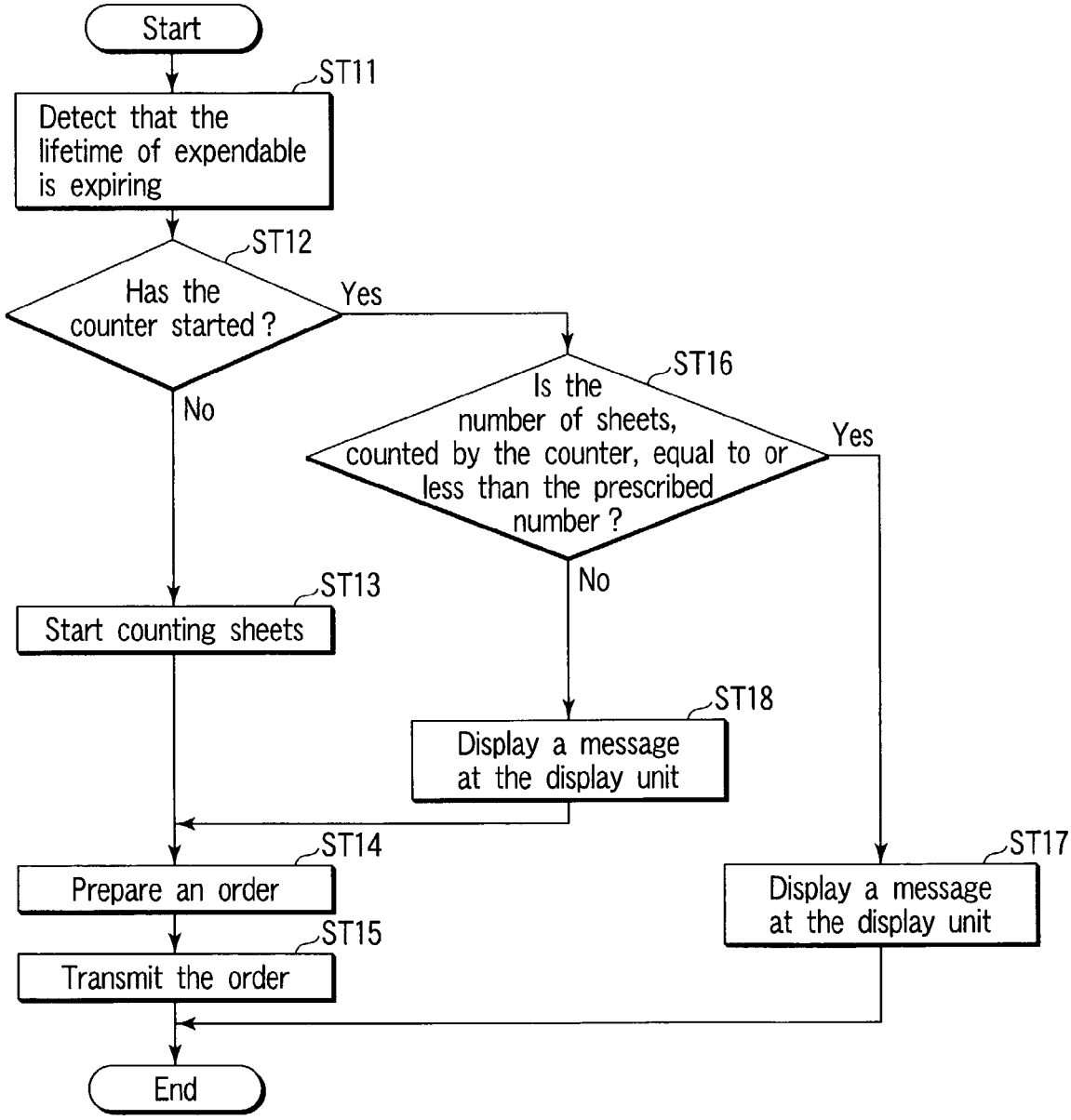
FIG. 6 is a flowchart depicting the process the CPU performs in the embodiment.
Figure 7:
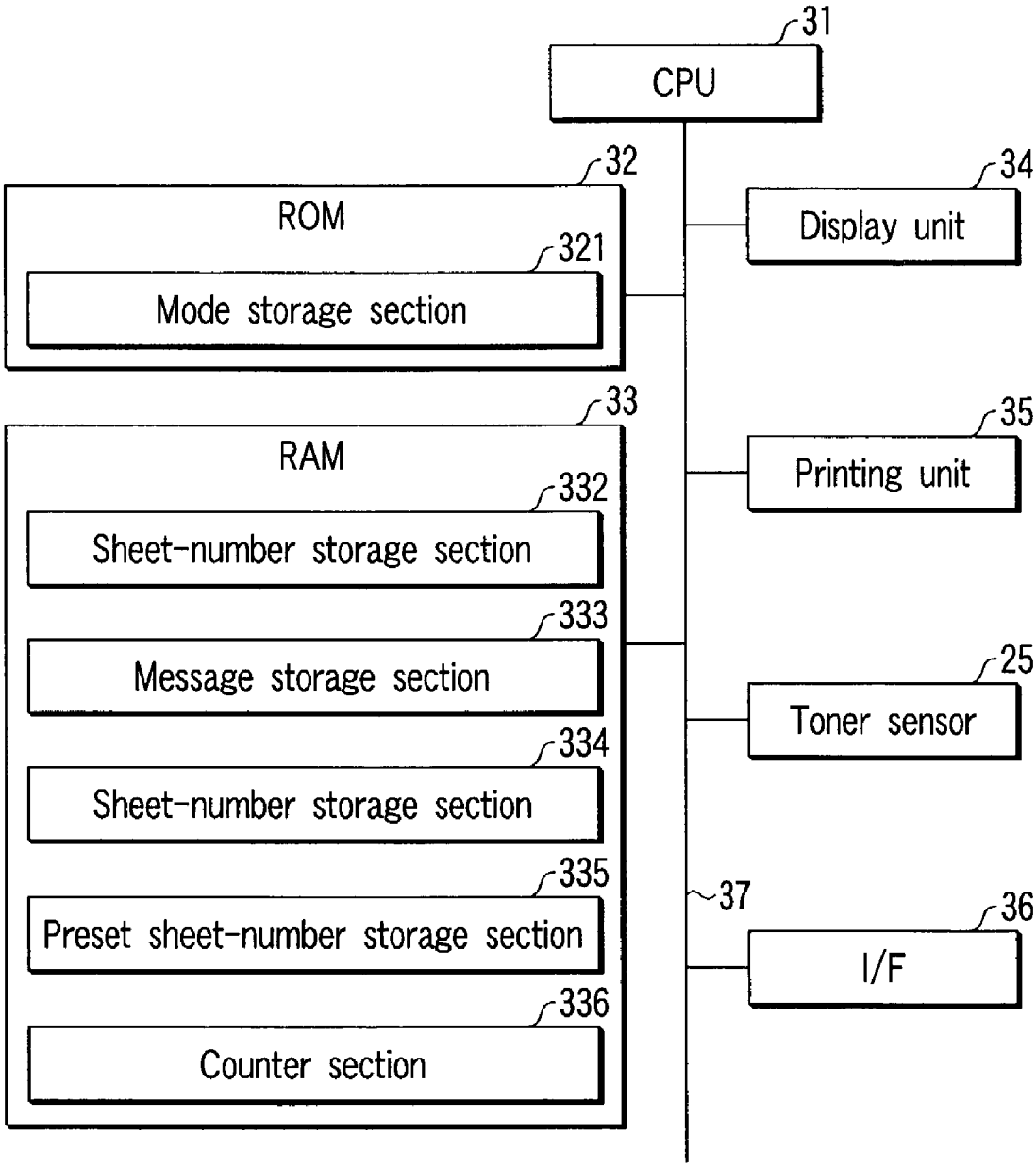
FIG. 7 is a diagram showing the control block of an image forming apparatus according to the second embodiment of this invention.

FIG. 6 is a flowchart depicting the process the CPU 31 performs when the toner sensor 25 detects that the toner is running out.

In Step ST11 it is determined that the toner sensor 25 has detected that the toner is running out, or that the lifetime of the toner cartridge 14 is expiring. In Step ST12 it is determined whether the toner counter 331 has started counting sheets. If it is not determined that the toner counter 331 has started counting sheets, the toner counter 331 starts counting sheets in Step ST13. Then, in Step ST14, an order for a toner cartridge 14 is automatically prepared. In Step S15, the order is transmitted to, for example, the computer 7 of the agency 5.

It may be detected in Step ST12 that the toner counter 331 has started counting sheets. In this case, it is determined in Step ST16 whether the number of printed sheets, counted and stored in the toner counter 331 has exceeded the prescribed number. If it is not determined that the number of printed sheets has exceeded the prescribed number, a message is read from the message storage section 333 in Step ST17. The display unit 34 displays the message. Then, the process is terminated.

It may be determined that the number of printed sheets has exceeded the prescribed number. If so, a message is read from the message storage section 333 in Step ST18. The display unit 34 displays the message. The process then goes to Step ST14, in which an order for a toner cartridge 14 is automatically prepared. In Step ST15, the order is transmitted to, for example, the computer 7 of the agency 5. The process is then terminated.

It will be described how the image forming apparatus 1 operates when the toner sensor 25 detects that the toner is running out.

When the toner sensor 25 detects that the toner is running out, the image forming apparatus 1 determines that the lifetime of the toner cartridge 14 is expiring. Then, the image forming apparatus 1 automatically prepares an order for a new toner cartridge 14 and transmits the order to the computer 7 of the agency 5 via the LAN 2, the server 3 and the Internet 4.

While an operator keeps using the image forming apparatus 1, it may no longer be detected, by accident, that the lifetime of the toner cartridge 14 is expiring. This may happen when a user turns on or off the power switch of the image forming apparatus or opens or closes the cover. Thereafter, the toner sensor 25 may detects again that the toner is running out. In this case, the image forming apparatus 1 does not prepare an order for a new toner cartridge if the number of sheets, which is stored in the toner counter 331, has not exceeded the prescribed number. The display unit 34 displays a message, "it has been detected that the toner is running out, after the order has been placed and before the prescribed number of sheets are printed." Then, another message of "Check the toner cartridge" is displayed. Reading the message, the operator can know that the lifetime of the toner cartridge 14 has not expired yet. The operator then removes the cartridge 14 from the image forming apparatus 1 and examines it. If the toner is part-solidified, the operator may shake the toner cartridge 14 to bring the toner back into the normal state.

If the number of sheets, which is stored in the toner counter 331, has exceeded the prescribed number when the toner sensor 25 detects again that the toner is running out, the image forming apparatus 1 automatically transmits an order for a new toner cartridge 14.

In this embodiment, even if the toner sensor 25 detects twice that the toner is running out, this fact detected is neglected and no orders for new toner cartridges are prepared until the prescribed number of sheets are printed. Hence, the order can be prevented from being transmitted twice by accident while sheets are being printed in the prescribed number after it has been detected that the lifetime of the toner cartridge 14 is expiring. If the order were transmitted twice, the user should be bothered to cancel the order transmitted for the second time, or the agency would unnecessarily send a serviceman to the user's office.

The toner sensor 25 may detect that the toner is running out and detects the same fact again when the number of sheets printed has exceeded the prescribed value. If so, the order is placed again for a new toner cartridge 14. This may take place when a toner cartridge used to some extent, not a new one, is inserted into the image forming apparatus, replacing the toner cartridge that has been used up. Thus, an order can be transmitted for not only a new toner cartridge, but also a cartridge used to some extent. Therefore a new toner cartridge is obtained.

Second Embodiment

The second embodiment will be described. The components identical to those of the embodiment described above are designated at the same reference numerals and will not be described in detail.

Only the features different from the embodiment described above will be described. The RAM 33 does not have an area for a toner counter 331. Instead, the RAM 33 has three areas for a sheet-number storage section 334, a preset sheet-number storage section 335 and a counter section 336, respectively. The sheet-number storage section 334 stores the number of sheets printed by using the drum 16. The preset sheet-number storage section 335 stores a preset number of sheets, which corresponds to the lifetime of the drum 16. The counter section 336 stores the number of sheets printed until the expiration of the lifetime of the drum 16 is detected.

The sheet-number storage section 334 and the preset sheet-number storage section 335 constitute a detecting section. Therefore, when the number of sheets printed by using the drum 16 exceeds the preset number of sheets, the CPU 31 determines that the lifetime of the drum 16 has just expired.

The embodiment can achieve the same advantages as the embodiment described above.

In the first embodiment, it is detected that the lifetime of the toner cartridge 14 is expiring. In the second embodiment, it is detected that the lifetime of the process unit 15 is expiring. Nonetheless, the image forming apparatus 1 may be configured to detect that the lifetime of the toner cartridge 14 is expiring and also that the lifetime of the process unit 15 is expiring.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a detecting section which detects that a lifetime of an expandable used to form images is expiring, based on only one parameter;

a counting section which counts a used amount of the expendable, from a time when the detecting section detects that the lifetime of the expendable is expiring; and a control section which disregards a subsequent detection by the detecting section that the lifetime of the expendable is expiring until the counted used amount of the expendable reaches a prescribed value;

wherein the expendable comprises a drum incorporated in a process unit.

2. An image forming apparatus according to claim 1, further comprising:

an interface to be connected communicably to a computer installed at a seller of the expendable; and wherein an order for the expendable is automatically placed with the computer installed at the seller of the expendable, when the detecting section detects that the lifetime of the expendable is expiring.

3. An image forming apparatus according to claim 1, further comprising:

a display section which displays a message when the detecting section makes the subsequent detection that the lifetime is expiring.

4. An image forming apparatus according to claim 1, wherein the used amount is a number of sheets printed by using the drum.

5. A method of operating an image forming apparatus, comprising:

detecting that a lifetime of an expendable used to form images is expiring, based on only one parameter;

counting a used amount of the expendable, from a time when the detecting section detects that the lifetime of the expendable is expiring; and disregarding a subsequent detection that the lifetime of the expendable is expiring, until the counted used amount of the expendable reaches a prescribed value;

wherein the expendable comprises a drum incorporated in a process unit.

6. A method of operating an image forming apparatus, according to claim 5, further comprising:

automatically placing an order for the expendable with a computer installed at a seller of the expendable, when it is detected that the lifetime of the expendable is expiring.

7. A method of operating an image forming apparatus, according to claim 5, further comprising:

displaying a message when the subsequent detection that the lifetime of the expendable is expiring occurs.

8. A method of operating an image forming apparatus, according to claim 5, wherein the used amount is a number of sheets printed by using the drum.

* * * * *